US007591900B2

(12) United States Patent
Shimai

(10) Patent No.: US 7,591,900 B2
(45) Date of Patent: Sep. 22, 2009

(54) NOZZLE FOR SUPPLYING TREATMENT LIQUID AND SUBSTRATE TREATING APPARATUS

(75) Inventor: Futoshi Shimai, Kanagawa (JP)

(73) Assignee: Tokyo Ohka Kogyo Co., Ltd., Kanagawa (JP)

( * ) Notice: Subject to any disclaimer, the term of this patent is extended or adjusted under 35 U.S.C. 154(b) by 438 days.

(21) Appl. No.: 11/504,344

(22) Filed: Aug. 15, 2006

(65) Prior Publication Data

US 2007/0045172 A1 Mar. 1, 2007

(30) Foreign Application Priority Data

Aug. 23, 2005 (JP) ..... 2005-240527

(51) Int. Cl.

| | |
|---|---|
| ***B05C 5/00*** | (2006.01) |
| ***B05C 11/00*** | (2006.01) |
| ***B05C 3/00*** | (2006.01) |
| ***B05B 1/04*** | (2006.01) |

(52) U.S. Cl. ..... 118/300; 118/410; 118/411; 239/568; 239/601

(58) Field of Classification Search ..... 118/300, 118/313, 401, 402, 404, 410, 324, 311; 239/601, 239/597, 599, 568, 562, 565; 396/604, 611, 396/627; 427/240; 134/153, 198, 902

See application file for complete search history.

(56) References Cited

U.S. PATENT DOCUMENTS

| | | | | |
|---|---|---|---|---|
| 5,720,820 | A * | 2/1998 | Boger et al. | 118/669 |
| 6,258,167 | B1 * | 7/2001 | Kawano et al. | 118/667 |
| 7,381,270 | B2 * | 6/2008 | Shimai et al. | 118/300 |

FOREIGN PATENT DOCUMENTS

| | | | |
|---|---|---|---|
| JP | 11145044 | A * | 5/1999 |
| JP | 2005-013960 | | 1/2005 |

* cited by examiner

*Primary Examiner*—Yewebdar T Tadesse
(74) *Attorney, Agent, or Firm*—Carrier, Blackman & Associates, P.C.; William D. Blackman; Joseph P. Carrier

(57) ABSTRACT

A nozzle for supplying a treatment liquid which makes it possible to perform uniform cleaning to a surface of a substrate even in a case where the size of a substrate is large. A slit-shaped ejection hole is formed at the lower end of the nozzle for supplying a treatment liquid. In the nozzle, a passage for supplying a treatment liquid which leads to the slit-shaped ejection hole is formed by bonding two nozzle parts to each other. Projections are provided on the abutting surface of at least one of the two nozzle parts so as to divide a treatment liquid flowing downward through the supply passage into left and right.

12 Claims, 3 Drawing Sheets

(a)

(b)

NOZZLE FOR SUPPLYING TREATMENT LIQUID AND SUBSTRATE TREATING APPARATUS

CROSS-REFERENCE TO RELATED APPLICATIONS

The present application claims priority under 35 USC 119 based on Japanese patent application No. 2005-181631, filed 23 Aug. 2005. The entire content of the priority Japanese application is incorporated herein by reference.

BACKGROUND OF THE INVENTION

1. Field of the Invention

The present invention relates to a nozzle for supplying a treatment liquid such as a cleaning liquid or a developing liquid to a substrate such as a glass substrate or a semiconductor wafer, and a substrate treating apparatus provided with the nozzle for supplying a treatment liquid.

2. Description of Prior Art

Large-screen and high-quality TFT-LCDs (Liquid Crystal Display device) are needed more and more in the fields of personal computers, televisions, mobile phones, and so on. One of the manufacturing steps for the LCD (Liquid Crystal Display) is a TFT array step. However, if there are fine particles (such as waste, dust, foreign materials) on the surface of the glass substrate in this step, the yield will deteriorate.

Thus, according to Patent Document 1, there has been known a method for removing fine particles from a surface of a glass substrate by cleaning. In the method of Patent Document 1, as shown in FIG. 6, fine particles adhering to the surface of the glass substrate are lifted up by ultrasonic waves applied from the lower surface of the glass substrate, and the lifted particles are washed away with ionized water with an adjustable flow.

Patent Document 1: Patent Application Publication No. 2005-013960

However, since this method requires an ultrasonic wave generating device, it is expected that the cost will be high. Also, if the size of a substrate is increased, ultrasonic waves cover only a small area, making it difficult to perform uniform cleaning to the substrate.

The present invention was made to solve the above-mentioned problems, and the object of the present invention is to provide a nozzle for supplying a treatment liquid which makes it possible to perform uniform cleaning to a surface of a substrate even in a case where the size of a substrate is large, and to provide a substrate treating apparatus provided with the nozzle for supplying a treatment liquid.

SUMMARY OF THE INVENTION

According to the present invention, there is provided a nozzle for supplying a treatment liquid comprising two parts bonded to each other, a slit-shaped ejection hole which opens to the lower end of the bonded two parts, and a supply passage for a treatment liquid which leads to the slit-shaped ejection hole, wherein projections are provided on the abutting surface of at least one of the two parts so as to divide the treatment liquid flowing downward through the supply passage to the left and right.

In the nozzle for supplying a treatment liquid according to the present invention, the treatment liquid flowing downward is divided by the projections provided in the supply passage. Since division of the treatment liquid is not uniform between the left and right sides, one of the sides has a larger flow rate than the other. The lower pressure on the side where the flow rate is lower attracts the larger flow causing the direction of flow to swing to the side with the lower pressure.

While the treatment liquid is ejected from the nozzle, the above-mentioned phenomenon occurs repeatedly. Therefore, it is possible to apply the treatment liquid flowing downward from the slit-shaped ejection hole onto the substrate with the direction of flow of the treatment liquid continuously swinging from left and right.

Therefore, when a cleaning liquid as the treatment liquid is allowed to flow downward in an actual substrate treating apparatus provided with the above-mentioned nozzle for supplying a treatment liquid, it is possible to perform uniform cleaning to the surface of the substrate.

In the substrate treating apparatus according to the present invention, the above-mentioned nozzle for supplying a treatment liquid is positioned above a conveying path of the nozzle, and the width direction of the substrate and the slit-shaped ejection hole of the nozzle for supplying a treatment liquid are positioned in parallel.

In the substrate treating apparatus according to the present invention, since the above-mentioned nozzle for supplying a treatment liquid is positioned above the conveying path, and the width direction of the substrate and the slit-shaped ejection hole of the nozzle for supplying a treatment liquid are positioned in parallel, it is possible to perform uniform cleaning to a surface of the substrate, and improve the cleaning efficiency with respect to particles on the substrate when a cleaning liquid is used as the treatment liquid.

With the nozzle for supplying a treatment liquid according to the present invention, it is possible to eject a treatment liquid in a predetermined cycle with the direction of flow of the treatment liquid swinging left and right in the longitudinal direction of the slit-shaped ejection hole.

With the substrate treating apparatus according to the present invention provided with the above-mentioned nozzle for supplying a treatment liquid, it is possible to perform uniform cleaning to a substrate and improve the cleaning efficiency.

Therefore, it is possible to provide a nozzle for supplying a treatment liquid suitable for cleaning treatment and developing treatment even in a case of a large-sized substrate.

DETAILED DESCRIPTION OF PRESENT EXEMPLARY EMBODIMENTS

Hereinafter, embodiments according to the present invention will be explained with respect to a case where the present invention is applied to a nozzle for supplying a cleaning liquid in which the cleaning liquid is ejected onto a substrate, and also applied to a substrate cleaning apparatus provided with the nozzle.

Figure 1:
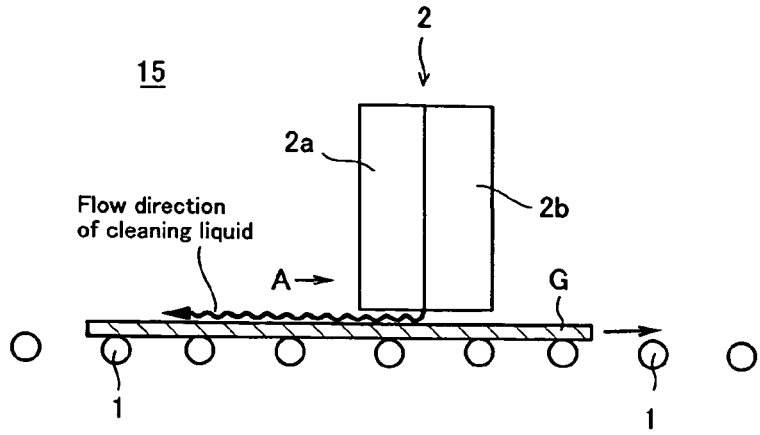
FIG. 1 is a side view of a substrate treating apparatus provided with a nozzle for supplying a treatment liquid according to an embodiment of the present invention.

As shown in FIG. 1, a substrate cleaning apparatus 15 according to an embodiment of the present invention has a plurality of rollers 1 for conveying a glass substrate G, and a nozzle 2 for supplying a cleaning liquid which is provided perpendicularly to the glass substrate G above the rollers 1.

In the substrate cleaning apparatus 15 having the above-mentioned structure, when the glass substrate G is conveyed, the cleaning liquid supplied from the nozzle 2 toward the glass substrate G flows in the relatively reverse direction to the direction of conveying the glass substrate G.

Also, the nozzle 2 for supplying a cleaning liquid can be moved without conveying the glass substrate G.

Figure 2:
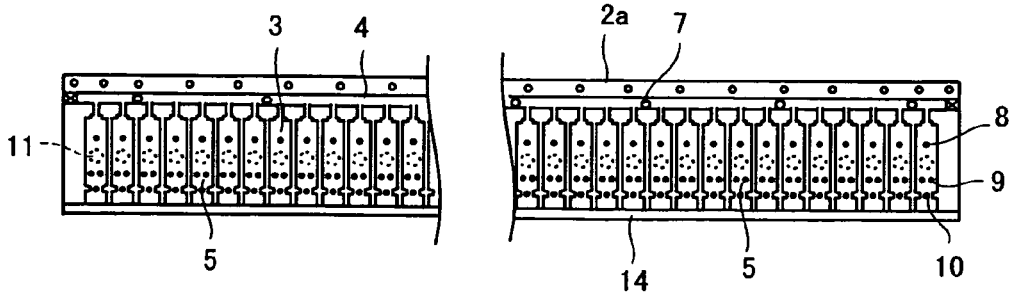
FIG. 2 shows an abutting surface of one of two abutting parts of the nozzle of FIG.1.
Figure 3:
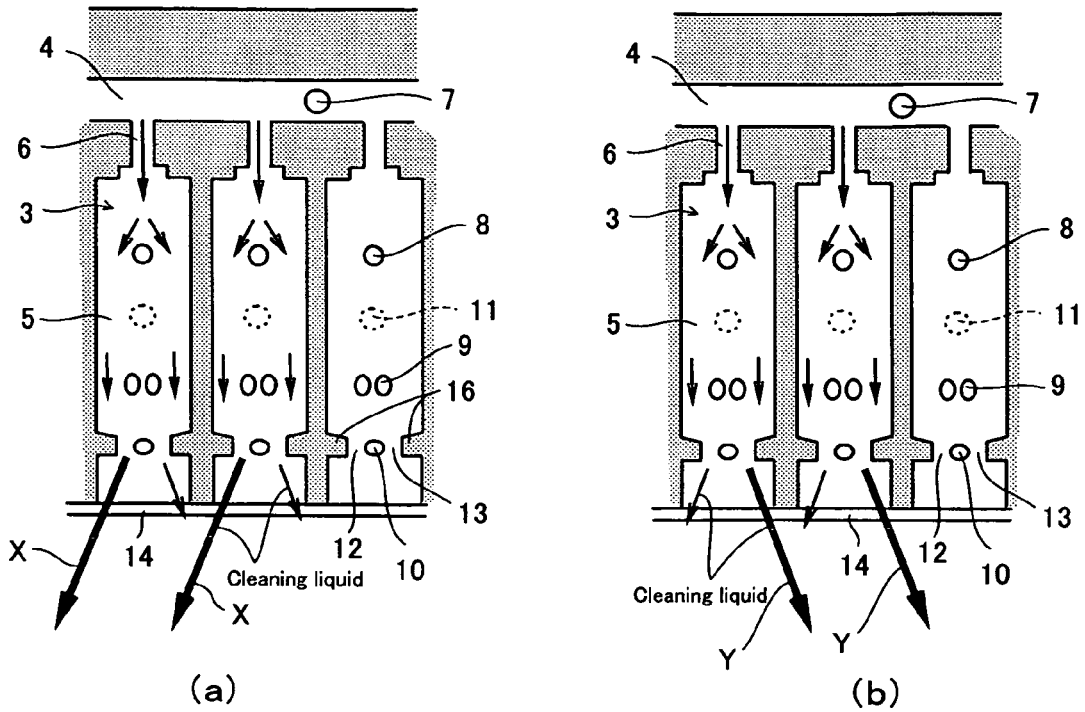
FIGS. 3(*a*) and (*b*) are enlarged views of a main part of FIG. 2.

As shown in FIGS. 1-3, the nozzle 2 for supplying a cleaning liquid has a structure in which a nozzle part 2*a* and a nozzle part 2*b* are bonded to each other. A passage 3 for supplying a cleaning liquid is formed in conjunction with the abutting surfaces of the parts. The passage 3 for supplying a cleaning liquid is comprised of a horizontal passage 4 which extends in a lateral direction in the upper area of the nozzle, and a plurality of vertical passages 5 which are distributed from the horizontal passage 4 downward.

Supply holes 7 are provided at a predetermined interval in the horizontal passage 4, and a cleaning liquid is supplied from the outside into the horizontal passage 4 through the supply holes 7. A narrow connecting passage 6 is provided between the horizontal passage 4 and each of the vertical passages 5.

Also, according to the present embodiment, projections are provided on the abutting surface of at least one of the two nozzle parts so as to divide a treatment liquid flowing downward through the supply passage to the left and right.

For example, in the vertical passages 5 distributed from the horizontal passage 4 downward in the abutting surface of the nozzle part 2*a*, projections (upper projections) 8 are provided in the upper area of the vertical passages 5, projections (intermediate projections) 9 are provided in the intermediate area of the vertical passages 5, and projections (lower projections) 10 are provided in the lower area of the vertical passages 5.

The intermediate projections 9 are provided so as to be a pair oriented next to each other horizontally. Air-supply openings 11 are provided between the intermediate projections 9 and the upper projections 8, so that clean dried air can flow through the openings 11. The upper, intermediate and lower projections 8, 9 and 10 are provided at a predetermined interval. A passageway 12 and a passageway 13 defined on the left and right of the lower projection 10, are reduced by side bulges 16.

In this way, the nozzle 2 for supplying a cleaning liquid is constructed by bonding the abutting surface 2*a* on which the projections 8, 9 and 10 are formed, and the abutting surface 2*b* on which no projections are formed.

Next, the flow of the cleaning liquid which is supplied to the horizontal passage 4 and ejected onto a surface of the glass substrate G will be explained in detail.

First, the horizontal passage 4 is filled with a cleaning liquid supplied from the supply holes 7, and the cleaning liquid enters the vertical passages 5 via the narrow passages 6.

The cleaning liquid is divided into left and right by the upper projections 8. Air (preferably, dried cool air) is supplied from the air-supply openings 11 into the cleaning liquid left and right flows thereby increasing the flow velocity of the cleaning liquid.

The cleaning liquid containing the air is divided into left and right flows again by the intermediate projections 9 and 9, flows through the passageway 12 and the passageway 13 formed on the left and right of the lower projections 10, and is ejected from a slit-shaped ejection hole 14 formed at the lower end of the nozzle toward the glass substrate G.

Next, the cleaning liquid flow through the passageway 12 and the passageway 13 will be described.

The direction and flow rate of the cleaning liquid flowing through the passageway 12 and the passageway 13 are controlled by the shape of the upper projections 8, the intermediate projections 9, and the lower projections 10. Therefore, even if the cross-sectional area of the passageway 12 and the passageway 13 is adjusted to be equal, imbalance still occurs.

For example, the flow rate in the passageway 12 is larger than the flow rate in the passageway 13 in FIG. 3*a*, and the cleaning liquid is directed to the left (see arrow X). Since the pressure in the passageway 13 is lower than the pressure in the passageway 12 in this state, the flow rate in the passageway 13 will increase as flow is attracted toward the region with the lower pressure. Consequently, the cleaning liquid is directed to the right as shown in FIG. 3*b* (see arrow Y).

Figure 4:
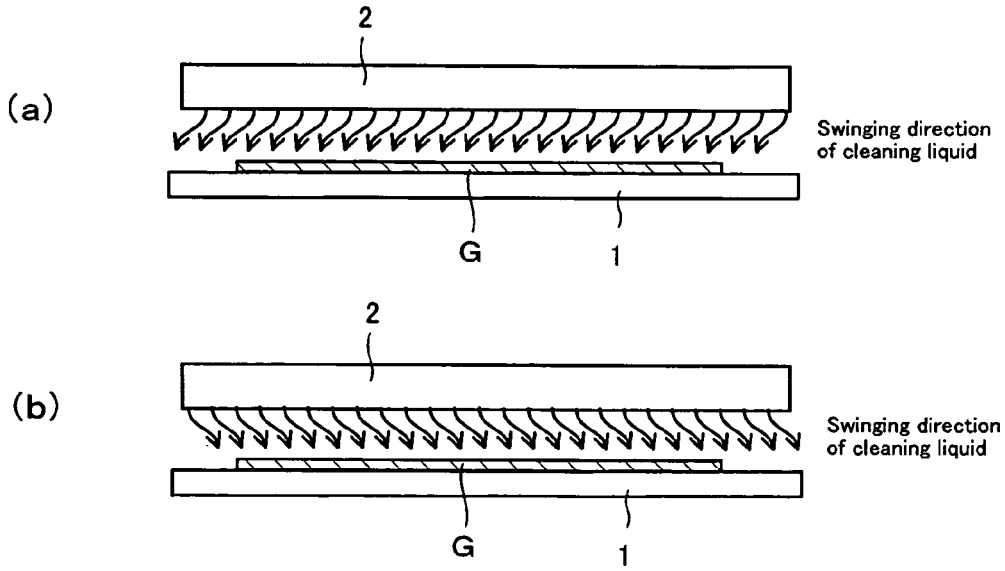
FIGS. 4(*a*) and (*b*) are views explaining the swinging direction of a treatment liquid ejected from the nozzle.

Since this phenomenon repeatedly occurs, the cleaning liquid ejected from the nozzle 2 for supplying a cleaning liquid toward the glass substrate G is alternately in a state of FIG. 4*a* and in a state of FIG. 4*b*. In other words, the cleaning liquid ejected from the nozzle 2 for supplying a cleaning liquid toward the glass substrate G swings left and right along the slit-shaped ejection hole 14.

The glass substrate G is conveyed in a direction perpendicular to the longitudinal direction of the slit-shaped ejection hole 14. Therefore, the cleaning liquid is ejected in a reverse direction to the conveying direction of the glass substrate G while swinging to the left and right in directions substantially parallel to the slit-shaped ejection hole (see arrow C). In this way, fine particles adhering to the surface of the glass substrate G can be removed effectively.

Figure 5:
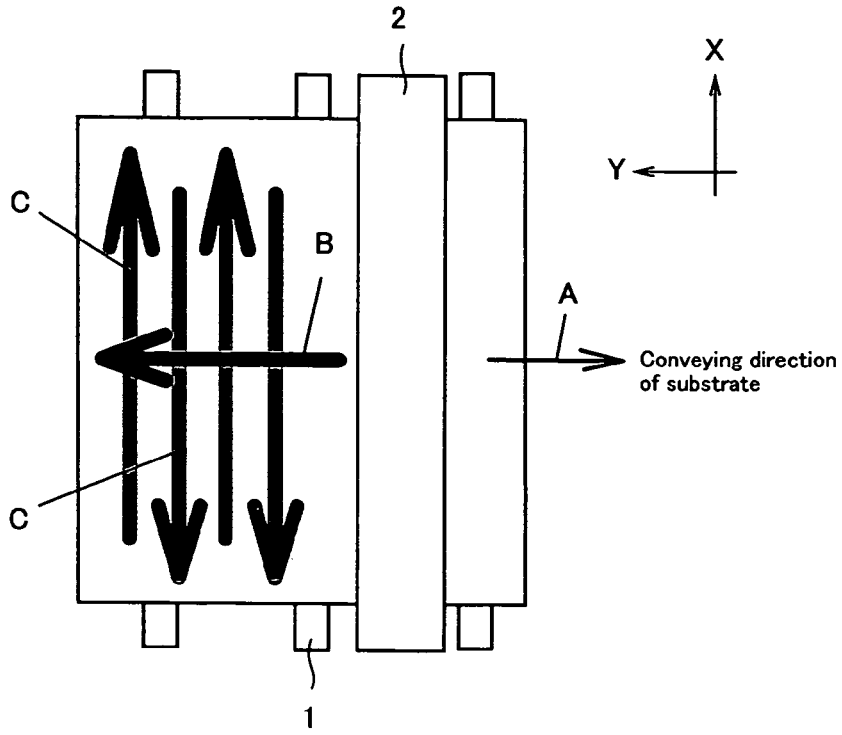
FIG. 5 is a view explaining the swinging direction of a treatment liquid ejected from the nozzle with respect to the conveyed substrate.
Figure 6:
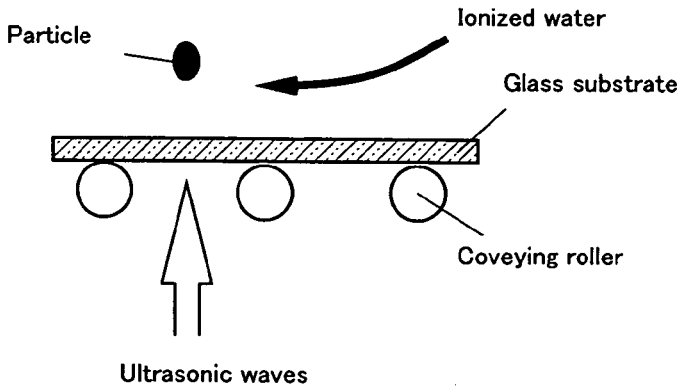
FIG. 6 Prior art
FIG. 6 shows a conventional example of a cleaning method.

More specifically, if the cleaning liquid is just ejected from the slit-shaped ejection hole 14 onto the surface of the glass substrate G, cleaning is performed only by force of the flow of the cleaning liquid (see arrow B) along the same axis (Y-axis) as the conveying direction of the glass substrate G (see arrow A) as shown in FIG. 5.

On the other hand, if the cleaning apparatus 15 according to the present embodiment is used, it is possible to perform cleaning by force of the flow of the cleaning liquid (see arrow C) along X-axis which intersects the conveying direction of the glass substrate G (see arrow A) as shown in FIG. 5.

In this way, the cleaning efficiency can be greatly improved by the force of the cleaning liquid which uniformly intersects the conveying direction of the glass substrate G compared to the case where cleaning is performed only by the force of the flow of the cleaning liquid (see arrow B) along the same axis (Y-axis).

As mentioned in the above, according to the present embodiment, it is possible to allow the treatment liquid ejected from the nozzle 2 for supplying a cleaning liquid onto the glass substrate G to swing left and right along the slit-shaped ejection hole 14.

With this, when the cleaning liquid as a treatment liquid is allowed to flow downward in the substrate cleaning apparatus 15 provided with the nozzle 2 for supplying a cleaning liquid, it is possible to further improve the effect of cleaning (removing) particles adhering to the substrate by swinging the cleaning liquid to the left and right compared to a conventional technique in which ultrasonic vibration is applied from the lower surface of the substrate.

Also, even in a case of a large substrate, it is possible to perform uniform cleaning to particles adhering to the substrate by swinging the cleaning liquid to the left and right and, unlike when ultrasonic waves are used, all areas will be cleaned uniformly.

Furthermore, it is possible to reduce the cost because there is no need of an ultrasonic generator.

In addition, according to the present embodiment, the air-supply openings 11 are provided in the course of the vertical passages 5, and air is supplied from the air-supply openings 11 at the time of ejecting the cleaning liquid onto the glass substrate G. With this, the flow rate of the cleaning liquid can be increased and the cleaning effect can be greatly improved.

In the above-mentioned embodiment, the projections provided in the vertical passages 5 are comprised of an upper one, intermediate ones and a lower one as shown in FIG. 3. However, the arrangement of the projections is not limited to this, and various embodiments are possible.

Also, in the above-mentioned embodiment, the projections are provided in the abutting surface 2*a*. However, the projections may be provided in both of the abutting surface 2*a* and the abutting surface 2*b*.

Also, in the above-mentioned embodiment, a cleaning liquid is used as the method for removing particles from the substrate. However, it is possible to perform the method by using air alone without using a cleaning liquid.

In such a case, air may be introduced from the supply holes 7 of the horizontal passage 4 in the nozzle 2 for supplying a cleaning liquid.

With this, air can be ejected onto the surface of the glass substrate G in the same manner as the case of the cleaning liquid so as to remove fine particles from the glass substrate G.

Incidentally, it is possible to improve the efficiency of cleaning particles by using dried air, ozone air, gas, or the like. It is also possible to achieve additional effectiveness by eliminating static charge by using ionized air.

Also, in the above-mentioned embodiment, the nozzle 2 for supplying a cleaning liquid is provided perpendicularly. However, the structure of the nozzle 2 for supplying a cleaning liquid is not limited to this, and the nozzle 2 for supplying a cleaning liquid may be provided obliquely in a state where the upper portion thereof is put forward, for example.

With this, the cleaning liquid can flow smoothly in a reverse direction to the conveying direction of the substrate G.

In the above-mentioned embodiment, air is mixed into the cleaning liquid so as to increase the flow velocity. However, it is not essential to mix air. It is still possible to eject the cleaning liquid from the nozzle 2 onto the glass substrate G in a state of swinging the cleaning liquid left and right along the slit-shaped ejection hole 14 so as to improve the effect of cleaning particles adhering to the substrate compared to a conventional technique in which ultrasonic vibration is applied from the lower surface of the substrate.

Further, by increasing the flow rate of the cleaning liquid, the swinging velocity of the cleaning liquid can be increased, and the cleaning efficiency can be improved.

In the above-mentioned embodiment, a cleaning liquid is used as the treatment liquid. However, a developing liquid can be used depending on the purpose. In this case, it is possible to perform uniform developing treatment to a film formed on a substrate.

Incidentally, the present invention is not limited to the above-mentioned embodiments, and various structures are possible within the scope of the present invention.

What is claimed is:

1. A nozzle for supplying a treatment liquid comprising:

two parts bonded to each other;

a slit-shaped ejection hole which opens at the bottom of the two bonded parts; and a supply passage for the treatment liquid which leads to the slit-shaped ejection hole, wherein projections are provided on an abutting surface of at least one of the two parts so as to divide the treatment liquid flowing downward through the supply passage to the left and right directions; wherein the supply passage is comprised of a horizontal passage in which a supply hole for the treatment liquid is provided and a plurality of vertical passages which are distributed from the horizontal passage downward, and the projections are provided in the plurality of vertical passages wherein said projections are disposed in vertically spaced locations within each of said plurality of vertical passages; and wherein the directions of the treatment liquid flowing through the supply passage is controlled by the shape of the projections.

2. The nozzle for supplying a treatment liquid according to claim 1, further comprising an air-supply opening provided in a course of the supply passage.

3. A substrate treating apparatus comprising the nozzle for supplying a treatment liquid according to claim 2 which is positioned above a conveying path of a substrate, wherein a width direction of the substrate and the slit-shaped ejection hole of the nozzle for supplying the treatment liquid are positioned in parallel.

4. A substrate treating apparatus comprising the nozzle for supplying a treatment liquid according to claim 1 which is positioned above a conveying path of a substrate, wherein a width direction of the substrate and the slit-shaped ejection hole of the nozzle for supplying the treatment liquid are positioned in parallel.

5. The substrate treating apparatus according to claim 4, wherein said projections divide the treatment liquid flowing downward through the supply passage to the left and right in directions substantially parallel to a longitudinal axis of the slit-shaped ejection hole.

6. A substrate treating apparatus comprising the nozzle for supplying a treatment liquid according to claim 1, which is positioned above a conveying path of a substrate, wherein a width direction of the substrate and the slit-shaped ejection hole of the nozzle for supplying the treatment liquid are positioned in parallel.

7. The nozzle for supplying a treatment liquid according to claim 1, wherein said projections are disposed in vertically spaced locations within said supply passage.

8. The nozzle for supplying a treatment liquid according to claim 1, wherein said projections divide the treatment liquid flowing downward through the supply passage to the left and right in directions substantially parallel to a longitudinal axis of the slit-shaped ejection hole.

9. A nozzle for supplying a treatment liquid, comprising:

two parts bonded to each other;

a slit-shaped ejection hole which opens at the bottom of the two bonded parts; and a supply passage for the treatment liquid which leads to the slit-shaped ejection hole;

wherein projections are provided on an abutting surface of at least one of the two parts so as to divide the treatment liquid flowing downward through the supply passage to the left and right; and wherein the supply passage is comprised of a horizontal passage in which a supply hole for the treatment liquid is provided and a plurality of vertical passages which are distributed from the horizontal passage downward, and the projections are provided in the plurality of vertical passages; and further comprising side bulges extending within said plurality of vertical passages, wherein said projections and said side bulges jointly define left and right passageways near lower ends of each of said plurality of vertical passages.

10. A nozzle for supplying a treatment liquid comprising:

two parts bonded to each other;

a slit-shaped ejection hole which opens at the bottom of the two bonded parts; and a supply passage for the treatment liquid which leads to the slit-shaped ejection hole, wherein projections are provided on an abutting surface of at least one of the two parts so as to divide the treatment liquid flowing downward through the supply passage to the left and right in directions substantially parallel to the slit-shaped ejection hole and such that the treatment liquid is discharged from the slit-shaped ejection hole while alternately swinging to the left and right; and wherein the supply passage is comprised of a horizontal passage in which a supply hole for the treatment liquid is provided and a plurality of vertical passages which are distributed from the horizontal passage downward, and the projections are provided in the plurality of vertical passages wherein said projections are disposed in vertically spaced locations within each of said plurality of vertical passages; and wherein the directions of the treatment liquid flowing through the supply passage is controlled by the shape of the projections.

11. The nozzle for supplying a treatment liquid according to claim 10, further comprising an air-supply opening provided in a course of the supply passage.

12. A nozzle for supplying a treatment liquid comprising:

two parts bonded to each other;

a slit-shaped ejection hole which opens at the bottom of the two bonded parts; and a supply passage for the treatment liquid which leads to the slit-shaped ejection hole, wherein projections are provided on an abutting surface of at least one of the two parts so as to divide the treatment liquid flowing downward through the supply passage to the left and right in directions substantially parallel to the slit-shaped ejection hole and such that the treatment liquid is discharged from the slit-shaped ejection hole while alternately swinging to the left and right; and wherein the supply passage is comprised of a horizontal passage in which a supply hole for the treatment liquid is provided and a plurality of vertical passages which are distributed from the horizontal passage downward, and the projections are provided in the plurality of vertical passages, and further comprising side bulges extending within said plurality of vertical passages, said projections and said side bulges jointly define left and right passageways near lower ends of each of said plurality of vertical passages.

* * * * *

UNITED STATES PATENT AND TRADEMARK OFFICE

CERTIFICATE OF CORRECTION

PATENT NO. : 7,591,900 B2
APPLICATION NO. : 11/504344
DATED : September 22, 2009
INVENTOR(S) : Shimai It is certified that error appears in the above-identified patent and that said Letters Patent is hereby corrected as shown below:

Column 1:
Line 9, change "Japanese patent application No." to --Japanese Patent Application No.--.

Column 2:
Line 18, change "nozzle, and" to --substrate, and--.

Column 6:
Line 8, change "directions; wherein" to --directions; and wherein--.

Signed and Sealed this

Twentieth Day of April, 2010

David J. Kappos

David J. Kappos
*Director of the United States Patent and Trademark Office*